US008416012B2

(12) United States Patent
Ashida

(10) Patent No.: US 8,416,012 B2
(45) Date of Patent: Apr. 9, 2013

(54) REFERENCE VOLTAGE GENERATING CIRCUIT AND ANALOG CIRCUIT USING THE SAME

(75) Inventor: Keiichi Ashida, Amagasaki (JP)

(73) Assignee: Ricoh Company, Ltd., Tokyo (JP)

( * ) Notice: Subject to any disclaimer, the term of this patent is extended or adjusted under 35 U.S.C. 154(b) by 145 days.

(21) Appl. No.: 13/008,503

(22) Filed: Jan. 18, 2011

(65) Prior Publication Data

US 2011/0181348 A1 Jul. 28, 2011

(30) Foreign Application Priority Data

Jan. 22, 2010 (JP) ..... 2010-012040

(51) Int. Cl.
*G05F 1/10* (2006.01)

(52) U.S. Cl.
USPC ..... 327/540; 327/308; 327/525

(58) Field of Classification Search ..... 327/308, 327/525, 538, 540, 541
See application file for complete search history.

(56) References Cited

U.S. PATENT DOCUMENTS

| | | | | |
|---|---|---|---|---|
| 6,163,288 | A | 12/2000 | Yoshizawa | |
| 6,628,162 | B2 * | 9/2003 | Kondo et al. | 327/540 |
| 7,064,602 | B2 * | 6/2006 | Nguyen | 327/541 |
| 7,079,127 | B2 * | 7/2006 | Morita | 345/212 |
| 7,589,581 | B2 * | 9/2009 | Kim | 327/525 |
| 7,592,855 | B2 * | 9/2009 | Kamatani | 327/525 |
| 7,956,676 | B2 * | 6/2011 | Noda | 327/540 |
| 2009/0051329 | A1 | 2/2009 | Ashida | |
| 2009/0295462 | A1 | 12/2009 | Itoh | |

FOREIGN PATENT DOCUMENTS

| | | |
|---|---|---|
| JP | 3253901 | 11/2001 |
| JP | 2007-233922 | 9/2007 |
| JP | 2009-55652 | 3/2009 |
| JP | 2009-131115 | 6/2009 |

* cited by examiner

*Primary Examiner* — Jeffrey Zweizig
(74) *Attorney, Agent, or Firm* — Cooper & Dunham LLP

(57) ABSTRACT

A reference voltage generating circuit includes a first power supply, a second power supply, a first variable resistance circuit having one end connected to the first power supply and configured to be capable of adjusting a resistance value of the first variable resistance circuit, a series resistance circuit having at least one resistance and one end connected to the first variable resistance circuit, a second variable resistance circuit having one end connected to the series resistance circuit and the other end connected to the second power supply, and configured to be capable of adjusting a resistance value of the second variable resistance circuit, a first terminal arranged between the first variable resistance circuit and the series resistance circuit, a second terminal arranged between the series resistance circuit and the second variable resistance circuit, and a voltage selecting circuit configured to select one of a voltage of the first terminal and a voltage of the second terminal, and output the selected voltage as a reference voltage.

6 Claims, 5 Drawing Sheets

REFERENCE VOLTAGE GENERATING CIRCUIT AND ANALOG CIRCUIT USING THE SAME

CROSS REFERENCE TO RELATED APPLICATIONS

The present application is based on and claims priority from Japanese Application Number 2010-012040, filed on Jan. 22, 2010, the disclosure of which is hereby incorporated by reference herein in its entirety.

BACKGROUND OF THE INVENTION

1. Field of the Invention

The present invention relates to a reference voltage generating circuit and an analog circuit using the same, particularly to a reference voltage generating circuit which is capable of selecting an output voltage, and an analog circuit using the same.

2. Description of the Related Art

FIG. 8 is a circuit diagram showing a conventional reference voltage generating circuit and a constant current circuit.

Resistances R4, R3, R2, R1, and R0 are connected in series between a power supply for a reference voltage V101 and a ground potential GND in a reference voltage generating circuit 101. For example, each of the resistances R0, R1, R2, and R3 is constituted of one unit resistance, and the resistance R4 is constituted of six unit resistances connected in series.

A selector 3 selects one of voltages of terminals N1, N2, N3, and N4 arranged between the adjacent resistances R0 to R4, and outputs the selected voltage as one of reference voltages REF1, REF2, REF3, and REF4. The selector 3 is, for example, disclosed in Japanese Patent No. 3253901.

A comparison circuit 7 is provided in a constant current circuit 5. A reference voltage from the reference voltage generating circuit 101 is connected to a non-inverting input terminal of the comparison circuit 7. An output terminal of the comparison circuit 7 is connected to a gate of an output transistor Tr. A drain of the output transistor Tr is connected to a power supply V2. A source of the output transistor Tr is connected to a ground potential GND via a resistance RA. A terminal A between the output transistor Tr and the resistance RA is connected to an inverting input terminal of the comparison circuit 7. In the constant current circuit 5, an output current I can be changed in accordance with the reference voltages REF1 to REF4 selected by the selector 3.

When a semiconductor device is mass-produced, a differential offset of the comparison circuit and a variation in resistance are unavoidable problems. In the circuit shown in FIG. 8, the comparison circuit 7 has a differential offset $\alpha$, and the resistance RA has a variation in resistance $\beta$ (magnification of an actual resistance value to a designed resistance value). A voltage value of the power supply for the reference voltage V101 of the reference voltage generating circuit 101 is adjusted, and thereby values of the reference voltages REF4, REF3, REF2, and REF1 are adjusted, and then the output current I in the constant current circuit 5 is adjusted.

Table 1 shows an example of a result of adjusting the output current I of the constant current circuit 5 by adjusting the voltage value of the power supply for the reference voltage V101 in the reference voltage generating circuit 101 and the constant current circuit 5 shown in FIG. 8. Here, in a case where the differential offset $\alpha$ of the comparison circuit 7 is 10 mV (millivolt), and the variation in resistance $\beta$ of the resistance RA is 1.1, the voltage value of the power supply for the reference voltage V101 is adjusted so that the output current I is 0.1 mA (milliampere) when the reference voltage REF1 is selected by the selector 3.

TABLE 1

| EACH OF REF OUTPUT AND INTENDED VALUE | | BEFORE TRIMMING | | | |
|---|---|---|---|---|---|
| REF OUTPUT | INTENDED VALUE OF CURRENT [mA] | REFERENCE VOLTAGE [V] | NUMBER OF RESISTANCES | VOLTAGE [V] | CURRENT [mA] |
| — | — | | 6 | — | — |
| REF4 | 0.4 | | 1 | 0.400 | 0.355 |
| REF3 | 0.3 | 1.000 | 1 | 0.300 | 0.264 |
| REF2 | 0.2 | | 1 | 0.200 | 0.173 |
| REF1 | 0.1 | | 1 | 0.100 | 0.082 |

| EACH OF REF OUTPUT AND INTENDED VALUE | | AFTER TRIMMING | | | | |
|---|---|---|---|---|---|---|
| REF OUTPUT | INTENDED VALUE OF CURRENT [mA] | REFERENCE VOLTAGE [V] | NUMBER OF RESISTANCES | VOLTAGE [V] | CURRENT [mA] | ERROR [mA] |
| — | — | | 6.00 | — | — | — |
| REF4 | 0.4 | | 1.00 | 0.480 | 0.427 | 0.027 |
| REF3 | 0.3 | 1.200 | 1.00 | 0.360 | 0.318 | 0.018 |
| REF2 | 0.2 | | 1.00 | 0.240 | 0.209 | 0.009 |
| REF1 | 0.1 | | 1.00 | 0.120 | 0.100 | 0.000 |

An intended adjustment has been performed in REF1 in which the output current I is set so as to be 0.1 mA. However, there is a problem in that an error between an output current value and the intended value increases, as the output current I increases; that is, a value of the output current I diverges away from the output current value (0.1 mA) of an adjustment target.

SUMMARY OF THE INVENTION

An object of the present invention is to provide a reference voltage generating circuit and an analog circuit using the same, which is capable of improving an accuracy of an integral non-linearity (INL) of the analog circuit to which a reference voltage is input, in the reference voltage generating circuit, in which a plurality of reference voltages are switched over in a voltage selecting circuit to be output, and the analog circuit using the same.

To achieve the above object, a reference voltage generating circuit according to an embodiment of the present invention includes a first power supply, a second power supply, a first variable resistance circuit having one end connected to the first power supply and configured to be capable of adjusting a resistance value of the first variable resistance circuit, a series resistance circuit having at least one resistance and one end connected to the first variable resistance circuit, a second variable resistance circuit having one end connected to the series resistance circuit and the other end connected to the second power supply, and configured to be capable of adjusting a resistance value of the second variable resistance circuit, a first terminal arranged between the first variable resistance circuit and the series resistance circuit, a second terminal arranged between the series resistance circuit and the second variable resistance circuit, and a voltage selecting circuit configured to select one of a voltage of the first terminal and a voltage of the second terminal, and output the selected voltage as a reference voltage.

DETAILED DESCRIPTION OF THE PREFERRED EMBODIMENTS

Preferred embodiments of the present invention will be explained in detail with reference to the accompanying drawings below.

Figure 1:
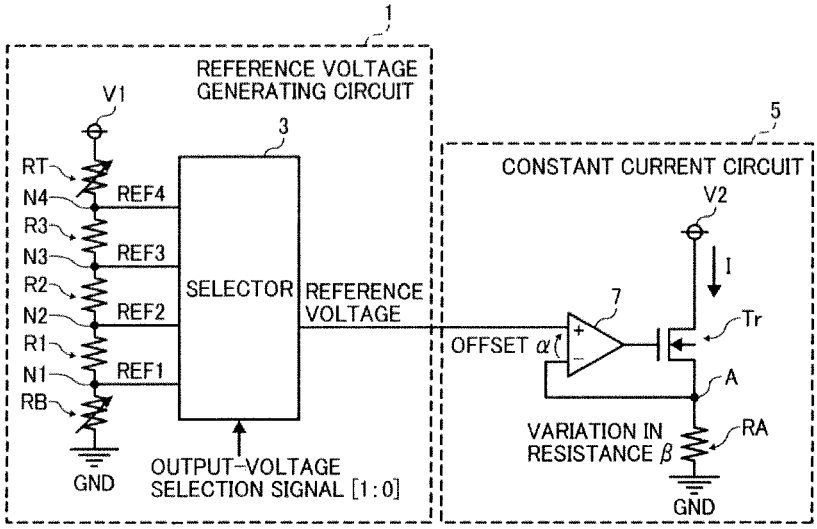
FIG. 1 is a circuit diagram showing a reference voltage generating circuit and a constant current circuit according to an embodiment of the present invention.

FIG. 1 is a circuit diagram showing a reference voltage generating circuit and a constant current circuit according to an embodiment of the present invention.

A reference voltage generating circuit 1 according to an embodiment of the present invention includes, for example, as shown in FIG. 1, a power supply for a reference voltage V1 as a first power supply, a ground potential GND as a second power supply, a first variable resistance circuit RT having one end connected to the first power supply V1 and capable of adjusting a resistance value of the first variable resistance circuit RT, a series resistance circuit having at least one resistance R1 and one end connected to the first variable resistance circuit RT, a second variable resistance circuit RB having one end connected to the series resistance circuit and the other end connected to the second power supply GND, and capable of adjusting a resistance value of the second variable resistance circuit RB, a first terminal N4 arranged between the first variable resistance circuit RT and the series resistance circuit, a second terminal N1 arranged between the series resistance circuit and the second variable resistance circuit RB, and a selector, as a voltage selecting circuit 3 configured to select one of a voltage of the first terminal N4 and a voltage of the second terminal N1, and output the selected voltage as a reference voltage.

The series resistance circuit may have a plurality of resistances R1, R2, and R3 connected in series. The reference voltage generating circuit 1 may include third terminals N2 and N3 respectively arranged between two resistances next to each other of the plurality of resistances R1, R2, and R3 constituting the series resistance circuit. Further, the voltage selecting circuit 3 may select one of the voltage of the first terminal N4, a voltage of each of the third terminals N2 and N3, and the voltage of the second terminal N1, and output the selected voltage as the reference voltage.

In the reference voltage generating circuit 1, the first variable resistance circuit RT, the series resistance circuit including the resistances R3, R2, and R1, and the second variable resistance circuit RB are connected in series between the power supply for the reference voltage V1 and the ground potential GND.

Figure 2:
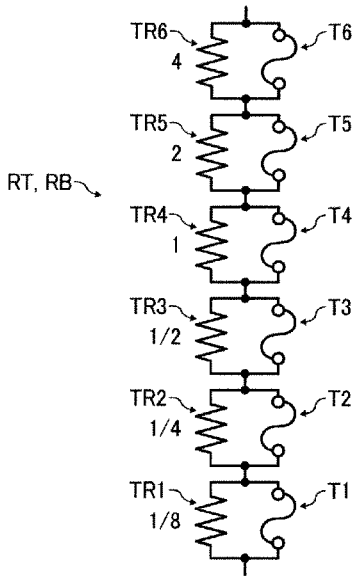
FIG. 2 is a view showing an example of variable resistance circuits RT, RB.

FIG. 2 is a view showing an example of the variable resistance circuits RT, RB.

Each of the first and second variable resistance circuits RT, RB may have a plurality of parallel circuits connected in series, each of the plurality of parallel circuits including a resistance and a fuse which are connected in parallel.

Each of the variable resistance circuits RT, RB includes six resistances TR1 to TR6 connected in series and fuses T1 to T6 connected in parallel to the resistances TR1 to TR6, respectively. For example, resistance values of the resistances TR1 to TR6 are set so as to be those of ⅛, ¼, ½, 1, 2, and 4 unit resistances, respectively. The fuses T1 to T6 are selectively cut off, and thereby a resistance value of each of the variable resistance circuits RT, RB is capable of being adjusted.

As shown in FIG. 1, the power supply for the reference voltage V1 is divided by the second variable resistance circuit RB, the resistances R1, R2, R3, and the first variable resistance circuit RT. A reference voltage REF1 is generated at a terminal N1 as the second terminal N1 between the second variable resistance circuit RB and the resistance R1. A reference voltage REF2 is generated at a terminal N2 as the third terminal N2 between the resistances R1 and R2. A reference voltage REF3 is generated at a terminal N3 as the third terminal N3 between the resistances R2 and R3. A reference voltage REF4 is generated at a terminal N4 as the first terminal N4 between the resistance R3 and the first variable resistance circuit RT.

For example, the power supply for the reference voltage V1 is 1V (volt), a resistance value of the first variable resistance circuit RT corresponds to resistance values of six unit resistances connected in series, a resistance value of each of the resistances R1, R2, R3, and the second variable resistance circuit RB corresponds to that of one unit resistance, and ten unit resistances in total are connected in series between the power supply for the reference voltage V1 and the ground potential GND. In such a circumstance, the reference voltage REF1 is 0.1V, the reference voltage REF2 is 0.2V, the reference voltage REF3 is 0.3V, and the reference voltage REF4 is 0.4V. In addition, it is assumed that the same kind of unit resistances are used as the resistances TR1 to TR6 used for the variable resistance circuits RT, RB, and the resistances R1, R2, R3, and absolute values of the resistances are ignorable.

The voltage selecting circuit 3 selects one of the voltages of the terminals N1 to N4 in accordance with, for example, a 2-bit output-voltage generation signal as a 2-bit output-voltage selection signal [1:0] and outputs one of the reference voltages REF1 to REF4.

An analog circuit according to an embodiment of the present invention may include a constant current circuit 5 having an output transistor Tr, for example, an Nch transistor configured to control an output current I, a resistance RA connected to the output transistor Tr in series, the reference voltage generating circuit 1 according to an embodiment of the present invention configured to supply the reference voltage, and a comparison circuit 7 configured to compare a voltage applied to the resistance RA with the reference voltage from the reference voltage generating circuit 1 and control an operation of the output transistor Tr in accordance with a comparison result.

The comparison circuit 7 is provided in the constant current circuit 5. The comparison circuit 7 has a differential offset α. The reference voltage from the reference voltage generating circuit 1 is connected to a non-inverting input terminal of the comparison circuit 7. An output terminal of the comparison circuit 7 is connected to a gate of the output transistor Tr. A drain of the output transistor Tr is connected to a power supply V2. A source of the output transistor Tr is connected to a ground potential GND via the resistance RA. A terminal A between the output transistor Tr and the resistance RA is connected to an inverting input terminal of the comparison circuit 7. The resistance RA has a variation in resistance B. The output current I can be changed in the constant current circuit 5 in accordance with the reference voltages REF1 to REF4 selected by the selector 3.

The resistance value of each of the resistances R1, R2, and R3 corresponds to that of the one unit resistance, and resistance ratios of the variable resistance circuits RT, RB to each of the resistances R1, R2, and R3 correspond to $F_{RT}$ times and $F_{RB}$ times as much as the unit resistance, respectively. Accordingly, the reference voltages REF1 to REF4 are indicated by the following formulas, using the resistance ratios, respectively:

$$REF1=F_{RB}/(F_{RT}+F_{RB}+3) \quad (1)$$

$$REF2=(F_{RB}+1)/(F_{RT}+F_{RB}+3) \quad (2)$$

$$REF3=(F_{RB}+2)/(F_{RT}+F_{RB}+3) \quad (3)$$

$$REF4=(F_{RB}+3)/(F_{RT}+F_{RB}+3) \quad (4)$$

Regarding the variable resistance circuits RT, RB, the resistance ratios thereof to each of the resistances R1, R2, and R3, each of which the resistance value corresponds to that of the one unit resistance, are adjusted to resistance values corresponding to the six unit resistances and the one unit resistance, respectively. Accordingly, the reference voltages REF1 to REF4 become 0.1V, 0.2V, 0.3V, and 0.4V, respectively.

Figure 3:
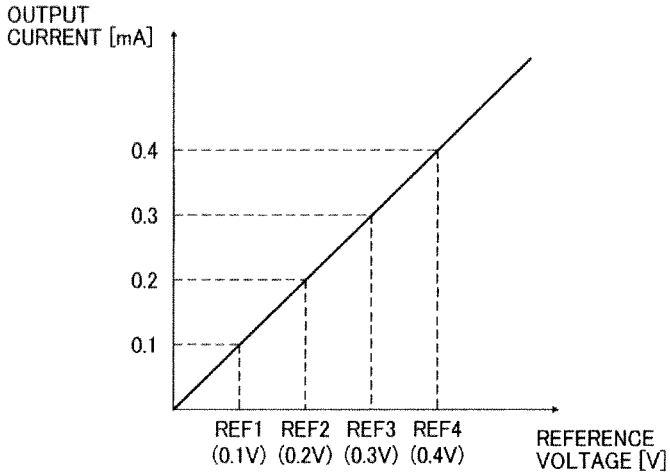
FIG. 3 is a view showing an ideal relationship between an output current value and a reference voltage in the constant current circuit of FIG. 1.

For example, in a case where there is no variation in manufacturing, that is, no differential offset α (α=0V) of the comparison circuit 7, and a resistance value of the resistance RA is, for example, 1 kΩ (kilo ohm) (a variation in resistance β=1) as intended, if values of the output currents I to the reference voltages REF1 to REF4 are I1, I2, I3, and I4, respectively, the constant current circuit 5 is set so that the following are satisfied: I1=0.1 mA, I2=0.2 mA, I3=0.3 mA, and I4=0.4 mA. In this circumstance, the output current values to the reference voltages are indicated as FIG. 3.

Figure 4:
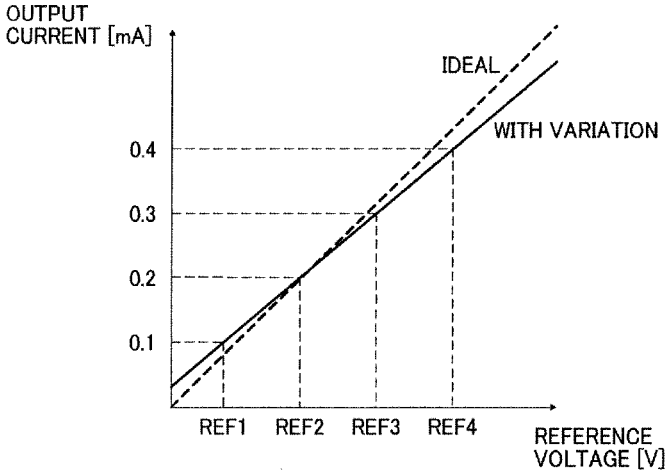
FIG. 4 is a view showing a relationship between an output current value and the reference voltage in the constant current circuit of FIG. 1 when a differential offset and a variation in manufacturing occur.

However, when a semiconductor device is manufactured, a differential offset of an operational amplifier and a variation in resistance are unavoidable problems. As shown in FIG. 4, in a case where there is the variation (refer to a solid line of FIG. 4), the output current values to the reference voltages deviate from ideal (refer to a broken line of FIG. 4).

In a case where the differential offset of the comparison circuit 7 is αV, and the resistance value of the resistance RA is β×kΩ (1 kΩ×the variation in resistance β), the resistance values of the variable resistance circuits RT, RB are adjusted, and thereby it is made possible to apply a desired current in the constant current circuit 5.

At first, values of the comparison circuit 7 are measured in a test.

Since an intended value of the output current I is 0.1 mA in a case where the reference voltage REF1 is selected, and an intended value of the output current I is 0.2 mA in a case where the reference voltage REF2 is selected, intended values of the output current I to the reference voltages REF1 and REF 2 are indicated by the following formulas, using measured values α and β obtained in the test, respectively:

$$(REF1-\alpha)/\beta=0.1 \quad (5)$$

$$(REF2-\alpha)/\beta=0.2 \quad (6)$$

When the resistance values $F_{RT}$, $F_{RB}$ of the variable resistance circuits RT, RB are evaluated with the formulas (1), (5), (2), and (6), the following formulas are obtained:

$$F_{RT}=(10-10\alpha)/\beta-4 \quad (7)$$

$$F_{RB}=1+10\alpha/\beta \quad (8)$$

The resistance ratios $F_{RT}$, $F_{RB}$ of the variable resistance circuits RT, RB are obtained, substituting the measured values α and β obtained in the test into the formulas (7) and (8). The resistance values of the variable resistance circuits RT, RB are adjusted so that values of the obtained resistance ratios $F_{RT}$, $F_{RB}$ are intended values, and thereby a desired output current I is obtained.

In the reference voltage generating circuit 1 and the constant current circuit 5 shown in FIG. 1, in a case where the differential offset a of the comparison circuit 7 and the variation 6 in resistance of the resistance RA, which are measured with a testing machine, are 10 mV and 1.1, respectively, Table 2 shows a result of an adjusted output current I of the constant current circuit 5 by adjusting the resistance values of the variable resistance circuits RT, RB. In Table 2, the resistance values of the resistances R1, R2, R3, and the variable resistance circuits RT, RB are shown by the number of the unit resistances connected in series.

TABLE 2

| EACH OF REF OUTPUT AND INTENDED VALUE | | BEFORE TRIMMING | | | |
|---|---|---|---|---|---|
| REF OUTPUT | INTENDED VALUE OF CURRENT [mA] | REFERENCE VOLTAGE [V] | NUMBER OF RESISTANCES | VOLTAGE [V] | CURRENT [mA] |
| — | — | | 6 | — | — |
| REF4 | 0.4 | | 1 | 0.400 | 0.355 |
| REF3 | 0.3 | 1.000 | 1 | 0.300 | 0.264 |
| REF2 | 0.2 | | 1 | 0.200 | 0.173 |
| REF1 | 0.1 | | 1 | 0.100 | 0.082 |

| EACH OF REF OUTPUT AND INTENDED VALUE | | AFTER TRIMMING | | | | |
|---|---|---|---|---|---|---|
| REF OUTPUT | INTENDED VALUE OF CURRENT [mA] | REFERENCE VOLTAGE [V] | NUMBER OF RESISTANCES | VOLTAGE [V] | CURRENT [mA] | ERROR [mA] |
| — | — | | 5.00 | — | — | — |
| REF4 | 0.4 | | 1.00 | 0.450 | 0.400 | 0.000 |
| REF3 | 0.3 | 1.000 | 1.00 | 0.340 | 0.300 | 0.000 |
| REF2 | 0.2 | | 1.00 | 0.230 | 0.200 | 0.000 |
| REF1 | 0.1 | | 1.09 | 0.120 | 0.100 | 0.000 |

When the resistance ratios $F_{RT}$, $F_{RB}$ are evaluated, substituting the differential offset $\alpha$=10 mV and the variation in resistance $\beta$=1.1 into the formulas (7) and (8), $F_{RT}$=5.0 (the number of the unit resistances) and $F_{RB}$=1.09 (the number of the unit resistances) are obtained. When the resistance values of the variable resistance circuits RT, RB are adjusted based on the obtained resistance ratios $F_{RT}$, $F_{RB}$, and voltage values of the reference voltages REF1 to REF4 are adjusted, it can be confirmed that the output currents I to the reference voltages REF1 to REF4 become 0.1 mA, 0.2 mA, 0.3 mA, and 0.4 mA as intended, respectively.

As mentioned above, in accordance with the reference voltage generating circuit 1, since the reference voltages REF1 to REF4 which are capable of canceling the offset and the variation in resistance of the constant current circuit 5 are generated in a small area, it is made possible to apply an intended current even in any output-current settings in the constant current circuit 5, and an accuracy of an integral non-linearity (INL) of the constant current circuit 5 can be improved.

Figure 5:
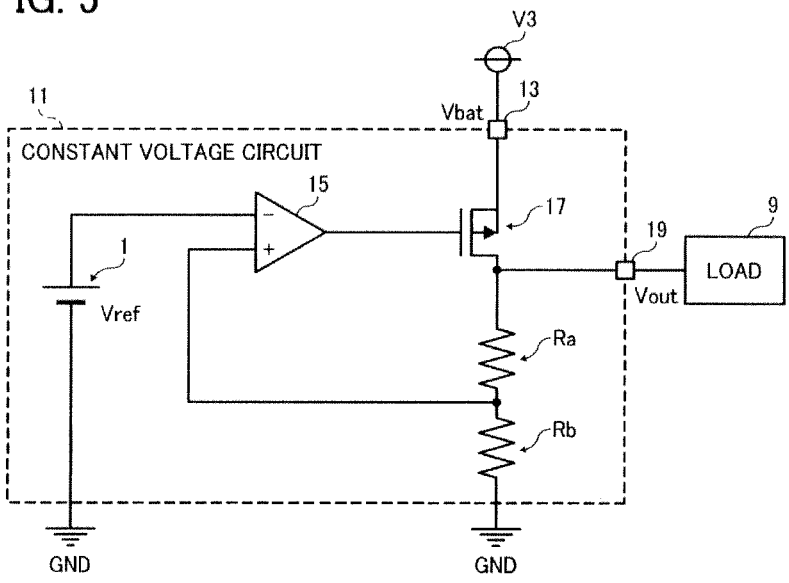
FIG. 5 is a circuit diagram showing the reference voltage generating circuit and a constant voltage circuit according to an embodiment of the present invention.

FIG. 5 is a circuit diagram showing the reference voltage generating circuit 1 and a constant voltage circuit 11 according to an embodiment of the present invention.

An analog circuit according to an embodiment of the present invention may include the constant voltage circuit 11 having an output transistor 17 configured to control an output voltage, a voltage-dividing resistance circuit including voltage-dividing resistances Ra and Rb, which is configured to divide the output voltage and supply a divided voltage, the reference voltage generating circuit 1 according to an embodiment of the present invention configured to supply the reference voltage (Vref), and a comparison circuit 15 configured to compare the divided voltage from the voltage-dividing resistance circuit with the reference voltage (Vref) from the reference voltage generating circuit 1 and control an operation of the output transistor 17 in accordance with a comparison result.

The constant voltage circuit 11 is provided in order to stably supply a load 9 with a power from a DC (direct-current) power supply V3. The constant voltage circuit 11 includes an input terminal (Vbat) 13 to which the DC power supply V3 is connected, the reference voltage generating circuit (Vref) 1, the comparison circuit 15, the output transistor 17, the voltage-dividing resistance circuit including the voltage-dividing resistances Ra and Rb, and an output terminal (Vout) 19. The reference voltage generating circuit 1 is the same as that shown in FIG. 1.

In the comparison circuit 15, an output terminal is connected to a gate electrode of the output transistor 17, the reference voltage Vref is impressed from the reference voltage generating circuit 1 to an inverting input terminal (−), an output voltage Vout is divided in the voltage-dividing resistances Ra and Rb, and the divided voltage is impressed to a non-inverting input terminal (+). The comparison circuit 15 controls the output transistor 17 so that the divided voltage of the voltage-dividing resistances Ra and Rb becomes equal to the reference voltages REF1 to REF4 from the reference voltage generating circuit 1. The reference voltages REF1 to REF4 from the reference voltage generating circuit 1 are switched over, and thereby the output voltages Vout can be switched over.

Also in this embodiment as well as the embodiment explained with reference to FIG. 1, a differential offset $\alpha$ of the comparison circuit 15 and variations $\beta$ of the voltage-dividing resistances Ra and Rb are measured, the resistance values of the variable resistance circuits RT, RB of the reference voltage generating circuit 1 are adjusted based on the measured values, and thereby it is made possible to output an intended voltage even in any output-voltage settings in the constant voltage circuit 11, and an accuracy of an integral non-linearity (INL) of the constant voltage circuit 11 can be improved.

Figure 6:
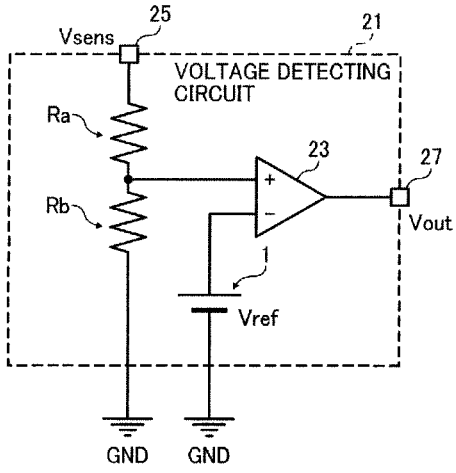
FIG. 6 is a circuit diagram showing the reference voltage generating circuit and a voltage detecting circuit according to an embodiment of the present invention.

FIG. 6 is a circuit diagram showing the reference voltage generating circuit 1 and a voltage detecting circuit 21 according to an embodiment of the present invention.

An analog circuit according to an embodiment of the present invention may include the voltage detecting circuit 21 having a voltage-dividing resistance circuit including voltage-dividing resistances Ra and Rb, which is configured to divide an input voltage and supply a divided voltage, the reference voltage generating circuit 1 according to an embodiment of the present invention configured to supply the reference voltage (Vref), and a comparison circuit 23 configured to compare the divided voltage from the voltage-dividing resistance circuit with the reference voltage (Vref) from the reference voltage generating circuit 1.

The comparison circuit 23 is provided in the voltage detecting circuit 21. In the comparison circuit 23, the reference voltage generating circuit 1 is connected to an inverting input terminal (−) of the comparison circuit 23, and the reference voltage Vref is impressed thereto. A voltage of a terminal to be measured, which is input from an input terminal (Vsens) 25, is divided by the voltage-dividing resistance circuit including the voltage-dividing resistances Ra and Rb and input to a non-inverting input terminal (+) of the comparison circuit 23. An output from the comparison circuit 23 is output outside via an output terminal (Vout) 27. The reference voltage generating circuit 1 is the same as that shown in FIG. 1.

In the voltage detecting circuit 21, when the voltage of the terminal to be measured is high, and the voltage divided by the voltage-dividing resistances Ra and Rb is higher than the reference voltage Vref, the output of the comparison circuit 23 maintains a level H. When the voltage of the terminal to be measured descends, and the voltage divided by the voltage-dividing resistances Ra and Rb becomes equal to or lower than the reference voltage Vref, the output of the comparison circuit 23 comes to a level L. The reference voltages REF1 to REF4 from the reference voltage generating circuit 1 are switched over, and thereby a voltage level to be detected can be switched over.

Also in this embodiment as well as the embodiment explained with reference to FIG. 1, a differential offset $\alpha$ of the comparison circuit 23 and variations $\beta$ of the voltage-dividing resistances Ra and Rb are measured, the resistance values of the variable resistance circuits RT, RB of the reference voltage generating circuit 1 are adjusted based on the measured values, and thereby it is made possible to detect an intended voltage level even in any voltage levels to be detected in the voltage detecting circuit 21, and an accuracy of an integral non-linearity (INL) of the voltage detecting circuit 21 can be improved.

Figure 7:
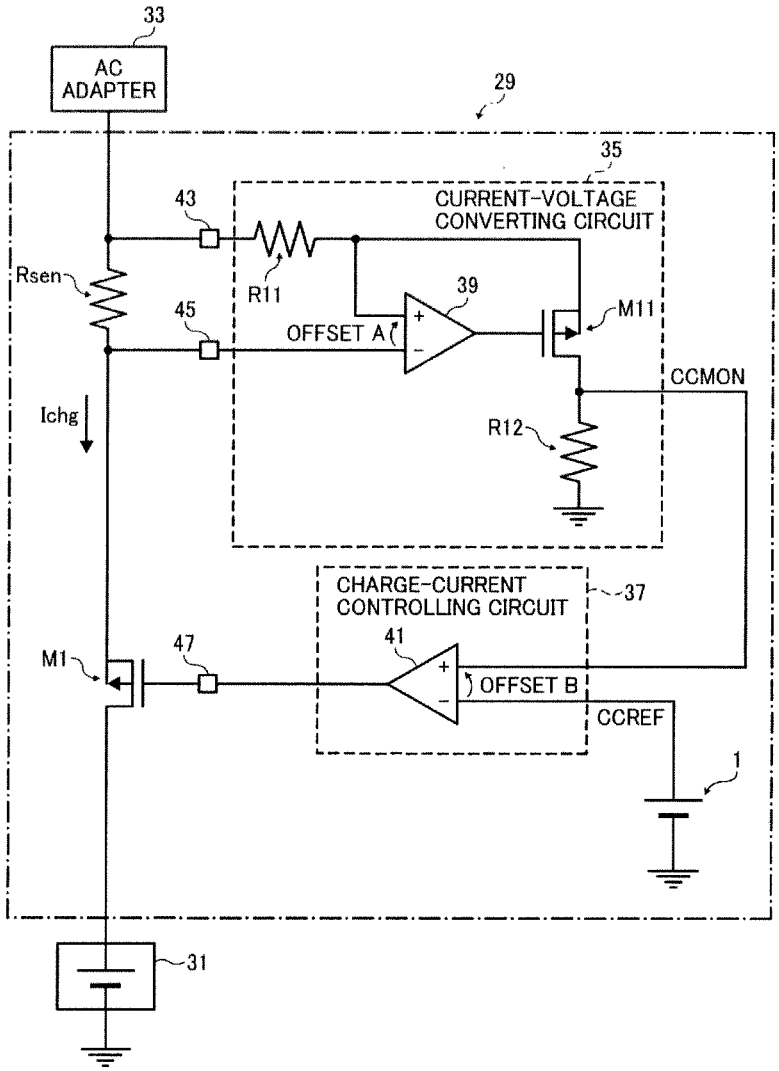
FIG. 7 is a circuit diagram showing the reference voltage generating circuit and a charging circuit according to an embodiment of the present invention.
Figure 8:
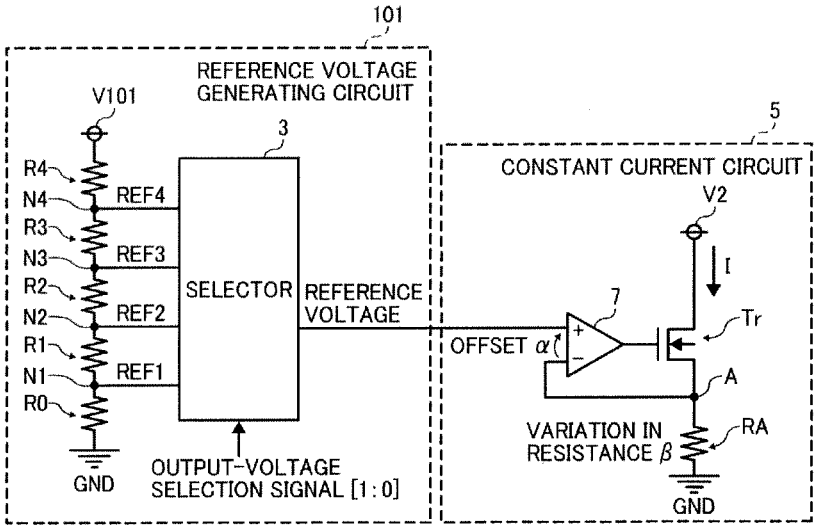
FIG. 8 is a circuit diagram showing a conventional reference voltage generating circuit and a constant current circuit.

FIG. 7 is a circuit diagram showing the reference voltage generating circuit 1 and a charging circuit 29 which charges a secondary battery 31 according to an embodiment of the present invention.

An analog circuit according to an embodiment of the present invention may include the charging circuit 29 configured to charge the secondary battery 31, the charging circuit 29 having a charge-current detecting resistance, that is, a resistance for charge-current detecting Rsen configured to detect a charge current Ichg applied to the charge-current detecting resistance Rsen, a current-voltage converting circuit 35 configured to output a monitor voltage CCMON according to the charge current Ichg, that is, a charge-current monitor voltage (hereinafter, referred to as a monitor voltage) CCMON on the basis of voltages at both ends of the charge-current detecting resistance Rsen, the reference voltage generating circuit 1 according to an embodiment of the present invention configured to supply the reference voltage CCREF, a charging transistor, that is, a transistor for charging M1 connected with the charge-current detecting resistance Rsen in series, and a charge-current controlling circuit 37 configured to compare the monitor voltage CCMON with the reference voltage CCREF from the reference voltage generating circuit 1 and output a control signal to control an operation of the charging transistor M1 so that a value of the monitor voltage CCMON becomes equal to that of the reference voltage CCREF. The charging transistor M1 is configured to receive the control signal output from the charge-current controlling circuit 37 and control the charge current Ichg to be supplied to the secondary battery 31 in accordance with the received control signal.

The charging circuit 29 charges the secondary battery 31 such as a lithium-ion battery and the like. An AC (alternating-current) adapter 33 is used as a power supply, and the secondary battery 31 is charged with a predetermined charge current Ichg.

The charging circuit 29 includes the resistance for charge-current detecting Rsen, the transistor for charging M1, the current-voltage converting circuit 35, the charge-current controlling circuit 37, and the reference voltage generating circuit 1. The reference voltage generating circuit 1 is the same as that shown in FIG. 1.

The resistance for charge-current detecting Rsen is to detect the charge current Ichg.

The transistor for charging M1 includes a PMOS transistor and supplies the secondary battery 31 with the charge current Ichg according to the control signal which is input to a gate of the transistor for charging M1. The resistance for charge-current detecting Rsen and the transistor for charging M1 are connected in series between an output terminal of the AC adapter 33, from which a power-supply voltage Vdd is output, and a positive electrode of the secondary battery 31.

The current-voltage converting circuit 35 converts the current applied to the resistance for charge-current detecting Rsen into a voltage and outputs the voltage as the monitor voltage CCMON. The current-voltage converting circuit 35 includes a comparison circuit 39, a PMOS transistor M11, a resistance R11, and a resistance R12.

The charge-current controlling circuit 37 includes a comparison circuit 41 to control the operation of the transistor for charging M1 so that the value of the monitor voltage CCMON becomes equal to that of the reference voltage CCREF.

A terminal arranged between the output terminal of the AC adapter 33 and the resistance for charge-current detecting Rsen is connected to a connecting terminal 43. A terminal arranged between the resistance for charge-current detecting Rsen and a source of the transistor for charging M1 is connected to a connecting terminal 45. The gate of the transistor for charging M1 is connected to a connecting terminal 47.

The resistance R11, the PMOS transistor M11, and the resistance R12 are connected in series between the connecting terminal 43 and a ground voltage. A terminal arranged between the resistance R11 and the PMOS transistor M11 is connected to a non-inverting input terminal of the comparison circuit 39. An inverting input terminal of the comparison circuit 39 is connected to the connecting terminal 45, and an output terminal of the comparison circuit 39 is connected to a gate of the PMOS transistor M11. The monitor voltage CCMON is output from a terminal arranged between the PMOS transistor M11 and the resistance R12.

The monitor voltage CCMON is input to a non-inverting input terminal of the comparison circuit 41 in the charge-current controlling circuit 37. The reference voltage CCREF from the reference voltage generating circuit 1 is input to an inverting input terminal of the comparison circuit 41. An output terminal of the comparison circuit 41 is connected to the gate of the transistor for charging M1 via the connecting terminal 47.

When the charge current Ichg is applied to the resistance for charge-current detecting Rsen, a voltage difference of "Ichg×Rsen" is produced between the both ends of the resistance for charge-current detecting Rsen. Each of the voltages at the both ends of the resistance for charge-current detecting Rsen is input to the current-voltage converting circuit 35, the voltage difference "Ichg×Rsen" is multiplied by "R12/R11"

in the comparison circuit 39 and the multiplied voltage is output as the monitor voltage CCMON.

The comparison circuit 41 of the charge-current controlling circuit 37 controls the operation of the transistor for charging M1 so that the value of the monitor voltage CCMON becomes equal to that of the reference voltage CCREF. The reference voltages REF1 to REF 4 from the reference voltage generating circuit 1 are switched over, and thereby the charge current Ichg can be switched over.

In a case where resistance values, which are measured with the testing machine, of the resistance for charge-current detecting Rsen, the resistance R11, and the resistance R12 are $F_{Rsen}$, $F_{R11}$, and $F_{R12}$, respectively, and a differential offset of the comparison circuit 39 and a differential offset of the comparison circuit 41, which are measured with the testing machine, are A and B, respectively, a relationship between the charge current Ichg and the reference voltage CCREF is expressed by the following formula (9):

$$(Ichg\times F_{Rsen}-A)\times F_{R12}/F_{R11}=\mathrm{CCREF}+\mathrm{B} \quad (9)$$

When the formula (9) is transformed, the following formula (10) is obtained:

$$Ichg=F_{R11}/(F_{R12}\times F_{Rsen})\times\mathrm{CCREF}+((F_{R11}\times B)/(F_{R12}\times F_{Rsen})+A/F_{Rsen}) \quad (10)$$

In the formula (10), in a case where "$F_{R11}/(F_{R12}\times F_{Rsen})=\alpha$" and "$(F_{R11}\times B)/(F_{R12}\times F_{Rsen})+A/F_{Rsen}=\beta$" are satisfied, the following formula (11) is obtained:

$$Ichg=\alpha\times\mathrm{CCREF}+\beta \quad (11)$$

For example, intended values Ichg1 and Ichg2 of the charge current Ichg, which correspond to REF1 and REF2 of a plurality of the reference voltages CCREF REF1 to REF4 supplied from the reference voltage generating circuit 1, respectively, are expressed by the following formulas (12) and (13), respectively, using the formula (11):

$$Ichg1=\alpha\times\mathrm{REF1}+\beta \quad (12)$$

$$Ichg2=\alpha\times\mathrm{REF2}+\beta \quad (13)$$

When formulas expressing the resistance ratios $F_{RT}$, $F_{RB}$ of the variable resistance circuits RT, RB, respectively, are evaluated with the formulas (1), (12), (2), and (13), and the resistance values $F_{Rsen}$, $F_{R11}$, and $F_{R12}$, which are obtained by measuring, and the above-mentioned α and β, which are obtained from the differential offsets A and B, are substituted into those formulas, the resistance ratios $F_{RT}$, $F_{RB}$ are obtained.

The above-mentioned α and β used in the formulas (12) and (13) are formulas including the resistance value $F_{Rsen}$. Even if the resistance value $F_{Rsen}$ varies from an intended value, for example, 0.1Ω, the above-mentioned α and β including the resistance value $F_{Rsen}$ are evaluated, the resistance values of the variable resistance circuits RT, RB are trimmed according to the evaluated α and β, and thereby a value of the charge current Ichg is to be the intended value. Accordingly, a variation of the resistance value $F_{Rsen}$ can be canceled.

The resistance values of the variable resistance circuits RT, RB are adjusted so that values of the obtained resistance ratios $F_{RT}$, $F_{RB}$ are as intended values, and thereby a desired charge current Ichg is obtained. Accordingly, it is made possible to apply an intended charge current even in any charge-current settings in the charging circuit 29, and an accuracy of an integral non-linearity (INL) of the charging circuit 29 can be improved.

Although the embodiments of the present invention are explained hereinbefore, the present invention is not limited thereto, and variations may be made within the scope of the present invention as defined by the following claims.

For example, resistance values of the resistances R1, R2, and R3 in the series resistance circuit including the resistances R1, R2, and R3 in the reference voltage generating circuit 1 may be different from each other. Further, the number of resistances is not limited to three in the series resistance circuit, and may be one or more.

Furthermore, it may be possible for basic resistances not to be used for the variable resistance circuits RT, RB, and the resistances R1, R2, and R3.

Furthermore, in the reference voltage generating circuit 1, the first power supply is not limited to the power supply for the reference voltage V1, and the second power supply is not limited to the ground potential GND. Any power supplies may be used for the first power supply and the second power supply.

Furthermore, the voltage selecting circuit 3 is not limited to the selector 3 according to the 2-bit output-voltage selection signal [1:0]. If the voltage selecting circuit 3 selects one of the voltage of the terminal N4 arranged between the first variable resistance circuit RT and the series resistance circuit, the voltages of the terminals N2 and N3 arranged between the resistances constituting the series resistance circuit, and the voltage of the terminal N1 arranged between the series resistance circuit and the second variable resistance circuit RB and outputs the selected voltage, the voltage selecting circuit 3 may be in any configuration.

Moreover, in the reference voltage generating circuit 1 according to an embodiment of the present invention, each of the variable resistance circuits RT, RB has the plurality of parallel circuits connected in series, each of the plurality of parallel circuits including the resistance and the fuse which are connected in parallel. However, a configuration of each of the variable resistance circuits RT, RB is not limited to such a configuration, and any configurations may be used if the resistance values of the variable resistance circuits RT, RB are capable of being adjusted.

In addition, the analog circuit to which the reference voltage generating circuit 1 according to an embodiment of the present invention is applied is not limited to the above-mentioned analog circuits.

INDUSTRIAL APPLICABILITY

The present invention may be applied to a reference voltage generating circuit having a plurality of resistances connected in series and configured to select one of terminals arranged between those resistances so as to be capable of switching over the terminals and output a voltage of the selected terminal as a reference voltage, and an analog circuit including a comparison circuit to which the reference voltage from the reference voltage generating circuit is input.

Since the reference voltage generating circuit 1 according to an embodiment of the present invention includes the first variable resistance circuit RT and the second variable resistance circuit RB, which are capable of adjusting the resistance values thereof, respectively, the resistance values of the first variable resistance circuit RT and the second variable resistance circuit RB are adjusted, and thereby the offset and the variation in manufacturing of the comparison circuit, the resistance, and so on in the analog circuit, which is a supply target of the reference voltage, can be resolved. Accordingly, the accuracy of the integral non-linearity (INL) can be improved in the analog circuit to which the reference voltage from the reference voltage generating circuit 1 is input, the reference voltage generating circuit 1 switching over a plurality of the reference voltages in the voltage selecting circuit 3 to output.

Further, if each of the first variable resistance circuit RT and the second variable resistance circuit RB is to be in a configuration such that the plurality of parallel circuits, each of which includes the resistance and the fuse, are connected in series, the variable resistance circuits RT, RB can be achieved in small areas.

Since the voltage detecting circuit 21, which is the analog circuit according to an embodiment of the present invention, is to include the reference voltage generating circuit 1 according to an embodiment of the present invention as a reference voltage generating circuit, magnitude of a voltage to be detected can be switched over in accordance with the reference voltage from the reference voltage generating circuit 1, which switches over a plurality of the reference voltages in the voltage selecting circuit 3 to output. Further, the offset and the variation in manufacturing of the comparison circuit 23, the voltage-dividing resistances Ra and Rb, and so on can be canceled, and the accuracy of the integral non-linearity (INL) of the voltage detecting circuit 21 can be improved.

Since the constant current circuit 5, which is the analog circuit according to an embodiment of the present invention, is to include the reference voltage generating circuit 1 according to an embodiment of the present invention as a reference voltage generating circuit, magnitude of an output current can be switched over in accordance with the reference voltage from the reference voltage generating circuit 1, which switches over a plurality of the reference voltages in the voltage selecting circuit 3 to output. Further, the offset and the variation in manufacturing of the comparison circuit 7, the resistance RA, and so on can be canceled, and the accuracy of the integral non-linearity (INL) of the constant current circuit 5 can be improved.

Since the constant voltage circuit 11, which is the analog circuit according to an embodiment of the present invention, is to include the reference voltage generating circuit 1 according to an embodiment of the present invention as a reference voltage generating circuit, magnitude of an output voltage can be switched over in accordance with the reference voltage from the reference voltage generating circuit 1, which switches over a plurality of the reference voltages in the voltage selecting circuit 3 to output. Further, the offset and the variation in manufacturing of the comparison circuit 15, the voltage-dividing resistances Ra and Rb, and so on can be canceled, and the accuracy of the integral non-linearity (INL) of the constant voltage circuit 11 can be improved.

Since the charging circuit 29, which is the analog circuit according to an embodiment of the present invention, is to include the reference voltage generating circuit 1 according to an embodiment of the present invention as a reference voltage generating circuit, magnitude of a charge current can be switched over in accordance with the reference voltage from the reference voltage generating circuit 1, which switches over a plurality of the reference voltages in the voltage selecting circuit 3 to output. Further, the offsets and the variation in manufacturing of the comparison circuits 39 and 41, the resistance, and so on can be canceled, and the accuracy of the integral non-linearity (INL) of the charging circuit 29 can be improved.

Although the present invention has been described in terms of exemplary embodiments, it is not limited thereto. It should be appreciated that variations may be made in the embodiments described by persons skilled in the art without departing from the scope of the present invention as defined by the following claims.

What is claimed is:

1. A reference voltage generating circuit, comprising:

a first power supply;

a second power supply;

a first variable resistance circuit having one end connected to the first power supply and configured to he capable of adjusting a resistance value of the first variable resistance circuit;

a series resistance circuit having at least one resistance and one end connected to the first variable resistance circuit;

a second variable resistance circuit having one end connected to the series resistance circuit and the other end connected to the second power supply, and configured to he capable of adjusting a resistance value of the second variable resistance circuit;

a first terminal arranged between the first variable resistance circuit and the series resistance circuit;

a second terminal arranged between the series resistance circuit and the second variable resistance circuit; and a voltage selecting circuit configured to select one of a voltage of the first terminal and a voltage of the second terminal, and output the selected voltage as a reference voltage, wherein each of the first and second variable resistance circuits has a plurality of parallel circuits connected in series, each of the plurality of parallel circuits including a resistance and a fuse which are connected in parallel.

2. The reference voltage generating circuit according to claim 1, wherein the series resistance circuit has a plurality of resistances connected in series;

the reference voltage generating circuit includes a third terminal arranged between two resistances next to each other of the plurality of resistances constituting the series resistance circuit; and the voltage selecting circuit is configured to select one of the voltage of the first terminal, a voltage of the third terminal, and the voltage of the second terminal, and output the selected voltage as the reference voltage.

3. An analog circuit, comprising:

a constant current circuit having an output transistor configured to control an output current, a resistance connected to the output transistor in series, a reference voltage generating circuit configured to supply a reference voltage, and a comparison circuit configured to compare a voltage applied to the resistance with the reference voltage from the reference voltage generating circuit and control an operation of the output transistor in accordance with a comparison result, the reference voltage venerating circuit including:

a first power supply;

a second power supply;

a first variable resistance circuit having end connected to the first power supply and configured to be capable of adjusting a resistance value of the first variable resistance circuit;

a series resistance circuit having at least one resistance and one end connected to the first variable resistance circuit;

a second variable resistance circuit having one end connected to the series resistance circuit and the other end connected to the second power supply, and configured to he capable of adjusting a resistance value of the second variable resistance circuit;

a first terminal arranged between the first variable resistance circuit and the series resistance circuit;

a second terminal arranged between the series resistance circuit and the second variable resistance circuit; and a voltage selecting circuit configured to select one of a voltage of the first terminal and a voltage of the second terminal and output the selected voltage as a reference voltage.

4. An analog circuit, comprising:

a constant voltage circuit having an output transistor configured to control an output voltage, a voltage-dividing resistance circuit configured to divide the output voltage and supply a divided voltage, a reference voltage generating circuit configured to supply a reference voltage, and a comparison circuit configured to compare the divided voltage from the voltage-dividing resistance circuit with the reference voltage from the reference voltage generating circuit and control an operation of the output transistor in accordance with a comparison result, the reference voltage generating circuit including:

a first power supply;

a second power supply;

a first variable resistance circuit having one end connected to the first power supply and configured to be capable of adjusting a resistance value of the first variable resistance circuit;

a series resistance circuit having at least one resistance and one end connected to the first variable resistance circuit;

a second variable resistance circuit having one end connected to the series resistance circuit and the other end connected to the second power supply, and configured to be capable of adjusting a resistance value of the second variable resistance circuit;

a first terminal arranged between the first variable resistance circuit and the series resistance circuit;

a second terminal arranged between the series resistance circuit and the second variable resistance circuit; and a voltage selecting circuit configured to select one of a voltage of the first terminal and a voltage of the second terminal, and output the selected voltage as a reference voltage.

5. An analog circuit, comprising:

a voltage detecting circuit having a voltage-dividing resistance circuit configured to divide an input voltage and supply a divided voltage, a reference voltage generating circuit configured to supply a reference voltage, and a comparison circuit configured to compare the divided voltage from the voltage-dividing resistance circuit with the reference voltage from the reference voltage generating circuit, the reference voltage generating circuit including:

a first power supply;

a second power supply;

a first variable resistance circuit having one end connected to the first power supply and configured to he capable of adjusting a resistance value of the first variable resistance circuit;

a series resistance circuit having at least one resistance and one end connected to the first variable resistance circuit;

a second variable resistance circuit having one end connected to the series resistance circuit and the other end connected to the second power supply, and configured to be capable of adjusting a resistance value of the second variable resistance circuit;

a first terminal arranged between the first variable resistance circuit and the series resistance circuit;

a second terminal arranged between the series resistance circuit and the second variable resistance circuit; and a voltage selecting circuit configured to select one of a voltage of the first terminal and a voltage of the second terminal, and output the selected voltage as a reference voltage.

6. An analog circuit, comprising:

a charging circuit configured to charge a secondary battery, the charging circuit having a charge-current detecting resistance configured to detect a charge current applied to the charge-current detecting resistance, a current-voltage converting circuit configured to output a monitor voltage according to the charge current on the basis of voltages at both ends of the charge-current detecting resistance, a reference voltage generating circuit configured to supply a reference voltage, a charging transistor connected with the charge-current detecting resistance in series, and a charge-current controlling circuit configured to compare the monitor voltage with the reference voltage from the reference voltage generating circuit and output a control signal to control an operation of the charging transistor so that a value of the monitor voltage becomes equal to that of the reference voltage, wherein the charging transistor is configured to receive the control signal output from the charge-current controlling circuit and control the charge current to be supplied to the secondary battery in accordance with the received control signal, and wherein the reference voltage generating circuit includes:

a first power supply;

a second power supply;

a first variable resistance circuit having one end connected to the first power supply and configured to be capable of adjusting a resistance value of the first variable resistance circuit;

a series resistance circuit having at least one resistance and one end connected to the first variable resistance circuit;

a second variable resistance circuit having one end connected to the series resistance circuit and the other end connected to the second power supply, and configured to he capable of adjusting a resistance value of the second variable resistance circuit;

a first terminal arranged between the first variable resistance circuit and the series resistance circuit;

a second terminal arranged between the series resistance circuit and the second variable resistance circuit; and a voltage selecting circuit configured to select one of a voltage of the first terminal and a voltage of the second terminal, and output the selected voltage as a reference voltage.

* * * * *